United States Patent [19]

Hasenack et al.

[11] Patent Number: 4,887,962

[45] **Date of Patent: * Dec. 19, 1989**

[54] PARTIAL COMBUSTION BURNER WITH SPIRAL-FLOW COOLED FACE

[75] Inventors: Hendricus J. A. Hasenack, Amsterdam; Ian Poll, The Hague, both of Netherlands

[73] Assignee: Shell Oil Company, Houston, Tex.

[ * ] Notice: The portion of the term of this patent subsequent to Sep. 12, 2004 has been disclaimed.

[21] Appl. No.: 156,675

[22] Filed: Feb. 17, 1988

[51] Int. Cl.[4] ..... F23D 1/00; C10J 3/50

[52] U.S. Cl. ..... 110/263; 431/160; 431/181; 431/187; 239/132.3; 239/433; 239/434.5; 239/424; 48/86 R; 48/DIG. 7

[58] Field of Search ..... 431/160, 181, 187, 284; 110/260, 261, 263; 48/DIG. 4, 197 R, 202, 203, 210, 86 R; 239/132, 132.1, 132.3, 422, 423, 424, 433, 434.5; 60/742

[56] References Cited

U.S. PATENT DOCUMENTS

| | | | |
|---|---|---|---|
| 2,172,383 | 9/1939 | Honn | 239/132.1 |
| 3,101,384 | 8/1963 | Metz | 239/132.3 |
| 3,175,817 | 3/1965 | Smith et al. | 239/132.3 X |
| 3,224,679 | 12/1965 | Kear et al. | 239/132.3 |
| 3,567,202 | 3/1971 | Mercatoris et al. | 239/132.3 |
| 3,607,157 | 9/1971 | Schlinger et al. | 418/206 |
| 3,874,592 | 4/1975 | Buschmann et al. | 239/132.3 |
| 4,193,773 | 3/1980 | Staudinger | 431/10 X |
| 4,350,103 | 9/1982 | Poll | 110/264 |
| 4,525,175 | 6/1985 | Stellaccio | 239/132.3 X |
| 4,547,145 | 10/1985 | Jahnke et al. | 431/76 |
| 4,666,397 | 5/1987 | Wenning et al. | 431/160 |
| 4,736,693 | 4/1988 | Clomburg, Jr. | 431/160 |
| 4,752,303 | 6/1988 | Materne et al. | 239/132.3 X |

FOREIGN PATENT DOCUMENTS

| | | |
|---|---|---|
| 129921 | 1/1985 | European Pat. Off. . |
| 198700 | 10/1986 | European Pat. Off. . |
| 2151348 | 7/1985 | United Kingdom . |

*Primary Examiner*—Carl D. Price
*Attorney, Agent, or Firm*—Ronald R. Reper

[57] ABSTRACT

Disclosed is a burner for the partial combustion of a solid carbonaceous fuel wherein coal, e.g., finely divided coal, is supplied to a reactor space via a central channel disposed along the longitudinal axis of the burner, and oxygen-containing gas is supplied via an annular channel surrounding said central channel, and heat from the combustion is removed from the hollow front face of the burner by coolant flowed through said front face spirally about the longitudinal axis of the burner.

3 Claims, 1 Drawing Sheet

FIG. 1
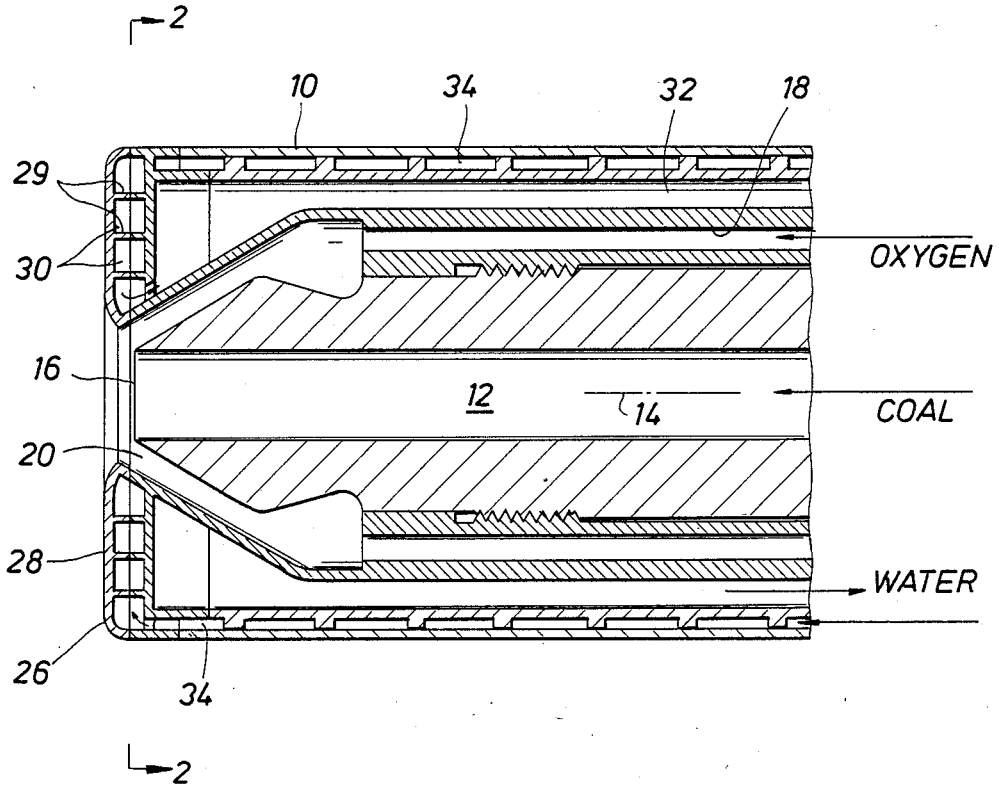
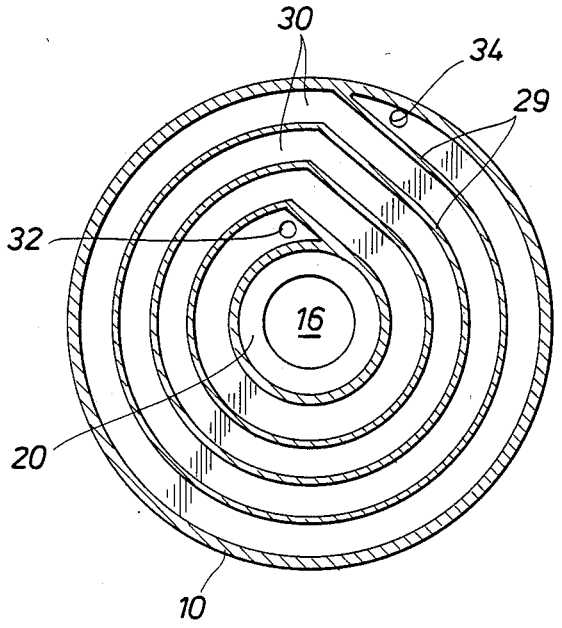
FIG. 2

PARTIAL COMBUSTION BURNER WITH SPIRAL-FLOW COOLED FACE

Related is patent application Ser. No. 156,679 filed of even date herewith directed to burner of similar construction but having two annular channels encompassing the central channel.

BACKGROUND OF THE INVENTION

The invention relates to a burner for use in the partial combustion of carbonaceous fuels, and particularly for the partial combustion of finely divided solid fuel such as pulverized coal, in which the fuel is introduced together with an oxygen-containing gas into a reactor space operating under a pressure up to 100 bar for producing pressurized synthesis gas, fuel gas or reducing gas.

Partial combustion, also known as gasification, of a solid carbonaceous fuel is obtained by the reaction of the fuel with oxygen. The fuel contains as combustible components, mainly carbon and hydrogen, which react with the supplied oxygen—and possibly with any steam and carbon dioxide as may be present—to form carbon monoxide and hydrogen. At some temperatures it is also possible to form methane.

There are in principle two different processes for the partial combustion of solid fuel. In the first process, solid fuel in particulate form is contacted with an oxygen-containing gas in the reactor in a fixed or fluidized bed at a temperature below about 1000° C. A drawback of this method is that not all types of solid fuel can be partially combusted in this manner. For example, high swelling coal is unsuitable since particles of such coal type easily sinter, resulting in risk of clogging of the reactor.

A more advantageous process passes the finely divided fuel in a carrier gas such as nitrogen or synthesis gas into a reactor at relatively high velocity. In the reactor a flame is maintained in which the fuel reacts with oxygen-containing gas at temperatures above 1000° C. The carbonaceous fuel is usually passed into the reactor via a burner, and the oxygen-containing gas is also passed via the burner into the reactor. In some processes a moderator gas such as steam or carbon dioxide is also passed via the burner to the reactor; such a moderator gas is often advantageous for reducing or preventing premature contact of the oxygen with the reactor gas, which might result in undesirable complete conversion of the reactor gas.

The present burner is well suited to introduce the reactants in any desired manner, i.e., vertically or horizontally, into the reaction zone of a conventional, refractory lined partial oxidation gas generator, and is particularly suited for use in solid fuel gasification apparatus having a plurality of burners for the reactants positioned on substantially opposite sides of the combustion zone, whereby the reactants are introduced horizontally and the burner jets impinge on each other to facilitate the partial oxidation process and to minimize erosion of the refractory wall.

Since flame temperatures may reach 2000° C. or more, a primary concern of such burners is to prevent damage to the burner front, also referred to as the burner face, caused by the high heat flux during the gasification process. To protect the burner front from overheating, it has been suggested to provide a refractory lining applied to the outer surface of the burner front wall and/or provide a hollow wall member with internal cooling passages through which cooling fluid is circulated at a rapid rate. The present invention provides an improved burner wherein the cooling fluid is used to flow in a particular manner to assure even cooling of the burner front face so as to minimize thermal stresses which could cause deterioration and even failure of the burner during prolonged operation.

SUMMARY OF THE INVENTION

In accordance with the invention there is provided a burner for the partial combustion of finely divided solid carbonaceous fuel with an oxygen containing gas in a combustion zone, said burner comprising:

a central channel and outlet for supplying fuel to the combustion zone;

a substantially annular channel disposed coaxially with said central channel and having an outlet to supply oxygen-containing gas flow to the combustion zone;

a front face disposed at the discharge end of said burner and normal to the longitudinal axis thereof, said front face having a central aperture through which said fuel and said oxygen-containing gas flow to the combustion zone; said front face comprising a hollow wall member operatively connected to: (a) a supply conduit disposed to supply fluid coolant to the proximate first end of a passageway in said hollow wall member; (b) a return conduit disposed to pass fluid coolant proximately from the other end of said passageway; and (c) including spiral flow means defining said passageway disposed within said hollow wall member to cause fluid coolant entering said hollow wall member from said supply conduit to flow in a spiral direction about the longitudinal axis of the burner.

The invention provides a burner that is capable of operation for extended periods of time without subjecting the front face and other burner components to excessive stress.

BRIEF DESCRIPTION OF THE DRAWINGS

The invention will now be described in more detail, by way of example only, with reference to the accompanying drawings, wherein:

FIG. 1 is a longitudinal section of the front part of a burner according to the invention; and FIG. 2 shows a cross-section of 2—2 of FIG. 1.

DESCRIPTION OF PREFERRED EMBODIMENTS

It should be noted that identical elements shown in the drawings have been indicated with the same reference numeral.

Referring to FIGS. 1 and 2, a burner, generally indicated with the reference numeral 10, for the partial combustion of a carbonaceous fuel, such as pulverized coal comprises central channel 12 disposed along longitudinal axis 14, and having a discharge outlet 16 for supplying a finely divided solid fuel in a carrier gas, e.g., nitrogen or synthesis gas, to a combustion zone. Concentrically arranged around the central channel 12 is substantially annular channel 18 for an oxidant gas having free end 20 forming an outlet for said oxidant gas flow into the combustion zone. Preferably outlet 20 is disposed at an angle of from about 15 to about 60 degrees with respect to the longitudinal axis 14, so that the issuing stream of oxygen-containing gas will intersect and mix with the stream of solid fuel issuing from outlet 16 into the downstream combustion zone. The oxidant gas, will be oxygen-containing gas, or optionally a mixture of oxygen-containing gas with a moderator gas such as, e.g., steam or carbon dioxide. Conventional separators are used for radially spacing the channels from each other, for example alignment pins, fins, centering vanes, spacers and other conventional means are used to symmetrically space the channels with respect to each other and to hold same in stable alignment with minimal obstruction to the free flow of the reactant streams.

The burner 10 further comprises a cylindrical hollow wall member 26 having an enlarged end part forming a front face 28 which is normal to the longitudinal axis 14 of the burner. The hollow wall member is interiorly provided with spiral flow means 29, which may be somewhat previous to fluids, but preferably is a fluid impervious barrier forming a spiral channel 30, said channel having one end operatively connected to supply conduit 34 for supplying fluid coolant to said spiral channel and having the other end of said spiral channel operatively connected to return conduit 32 to pass fluid coolant from said channel 30. The supply conduit may be operatively connected to either end of the spiral channel, and the return conduit to the other end, as desired. However, it is preferred that the supply conduit provide the fluid coolant, particularly a liquid coolant such as tempered water to the outside end of spiral channel 30.

It is an advantage of the present invention that it permits convective and radiant heat transfer from the combustion downstream of the burner face while avoiding, substantially or altogether, boiling of the coolant liquid within the hollow wall member. The use of high velocity coolant through the spiral channel assures even, low metal temperature in the burner face thereby enabling long life of the burner.

When water is used as coolant, preferably it is supplied to the hollow wall member at a flow rate sufficiently high that at maximum heat output of the burner the water entering the return conduit will have increased no more than about 5° C. and most preferably less than about 3° C. It is found advantageous to employ as coolant tempered water having a temperature in the range below about 210° C.

During operation of the above described burner 10 for the gasification of carbonaceous fuel, e.g., pulverized coal by means of oxygen-containing gas, said coal suspended in a carrier fluid, such as, e.g., nitrogen, synthesis gas or carbon dioxide, is passed through the central channel 12 to outlet 16 for introducing the coal into the combustion zone of a reactor arranged downstream of the burner. Simultaneously, oxygen-containing gas is passed through annular channel 18 to outlet 20 so that the coal and oxygen-containing gas reactants will be intensively mixed in the reactor space. The mixing of the reactants can be further promoted by a swirling motion imparted to one or both streams by a swirl body of baffles (not shown) in the appropriate channel. To promote stable outflow of coal the cross sectional area available for the coal flow should be kept constant over at least part of central channel 12 of the burner near the outlet.

During operation of the burner for the gasification of pulverized fuel, a temperature moderating gas such as steam, carbon dioxide or nitrogen also may be introduced into the feed line of annular channel so that a mixture of oxygen-containing gas and moderating gas, is conveyed through annular channel 18 to outlet 20 to control the temperature and to limit the amount of oxygen as needed. The rate of flow for each of the streams of pulverized fuel, and oxygen-containing gas optionally mixed with temperature moderator gas is controlled by a flow control valve (not shown) in each feedline upstream of the burner. The burner firing rate, i.e., turnup or turndown of the burner, is effected by changing the flow rate for each of the streams while maintaining a substantially constant ratio of atomic oxygen to carbon in the solid feed. Generally an oxygen demand of 0.9 to 1 ton per ton of moisture and ash-free coal is fairly typical of hard coals; for low rank coals 0.7 tons oxygen per ton is more representative.

The burner will ordinarily be fabricated of high temperature resistant materials, particularly high temperature resistant metals and alloys such as sold under the trade name Inconel and be fabricated by techniques of welding and/or brazing conventionally employed with such materials. For high duty operations the channels and outlets for oxygen-containing gas, which are usually made of metal, may be internally coated with an oxidic coating, such as $ZrO_2$, or a ceramic, enabling the application of high oxygen-containing gas velocities without the risk of metal combustion by the oxygen.

The term solid carbonaceous fuel as used herein is intended to include various materials and mixtures thereof from the group of coal, coke from coal, coal liquefaction residues, petroleum coke, soot and particulate solids derived from oil shale, tar sands and pitch. The coal may be of any type, including lignite, subbituminous, bituminous and anthracite. The solid carbonaceous fuels are preferably ground to a particle size so that at least about 90% by weight of the material is less than 90 microns and moisture content is less than about five per cent weight.

The term "oxygen-containing gas" as used herein is intended to refer to gas containing free oxygen, i.e., uncombined oxygen, and to include air, oxygen-enriched air, i.e., greater than 21 mole % oxygen, and also substantially pure oxygen, i.e., greater than about 95 mole % oxygen, with the remainder comprising gases normally found in air such as nitrogen and the rare gases.

What is claimed is:

1. A burner for the partial combustion of finely divided solid carbonaceous fuel with an oxygen containing gas in a combustion zone, said burner having a longitudinal axis and a discharge end, which burner comprises:

a central channel disposed along the longitudinal axis of said burner and having outlet at said discharge end for supplying fuel to the combustions zone;

a substantially annular channel disposed coaxially with said central channel and having a free end forming an outlet at said discharge end an outlet disposed at an angle of from about 15 to about 60 degrees with respect to said longitudinal axis to supply an oxidant gas flow to intersect and mix with solid fuel from said outlet of said central channel to the combustion zone;

a front face disposed at said discharge end of said burner and normal to the longitudinal axis thereof, said front face having a central aperture through which said fuel and oxidant gas flow to the combustion zone; said front face comprising a hollow wall member operatively connected to: (a) a supply conduit disposed to supply fluid coolant to the proximate first end of a passageway in said hollow wall member; said passage having a first end and a final end, (b) a return conduit disposed to pass fluid coolant proximately from said final end of said passageway; and (c) including spiral flow means defining said passageway disposed within said hollow wall member to cause fluid coolant entering said hollow wall member from said supply conduit to flow in a spiral direction about the longitudinal axis of the burner.

2. The burner of claim 1 wherein said spiral flow means comprises a continuous impervious barrier forming a spiral channel within said hollow wall member.

3. The burner of claim 1 wherein said hollow wall member, said final end of the passageway for cooling fluid is disposed adjacent to said central aperture.

* * * * *